US006954193B1

(12) United States Patent
Andrade et al.

(10) Patent No.: US 6,954,193 B1
(45) Date of Patent: Oct. 11, 2005

(54) METHOD AND APPARATUS FOR CORRECTING PIXEL LEVEL INTENSITY VARIATION

(75) Inventors: Jose Olav Andrade, Aptos, CA (US); Kok Chen, Sunnyvale, CA (US); Peter N. Graffagnino, San Francisco, CA (US); Gabriel G. Marcu, San Jose, CA (US)

(73) Assignee: Apple Computer, Inc., Cupertino, CA (US)

( * ) Notice: Subject to any disclaimer, the term of this patent is extended or adjusted under 35 U.S.C. 154(b) by 383 days.

(21) Appl. No.: 09/657,532

(22) Filed: Sep. 8, 2000

(51) Int. Cl.[7] ..... G09G 3/36
(52) U.S. Cl. ..... 345/90; 345/87; 345/204; 345/690
(58) Field of Search ..... 345/690, 87–90, 345/204, 687, 790–791

(56) References Cited

U.S. PATENT DOCUMENTS

| | | | | | |
|---|---|---|---|---|---|
| 4,788,588 | A * | 11/1988 | Tomita | 348/602 |
| 5,410,609 | A * | 4/1995 | Kado et al. | 382/118 |
| 5,489,918 | A * | 2/1996 | Mosier | 345/89 |
| 5,764,209 | A * | 6/1998 | Hawthorne et al. | 345/87 |
| 6,002,386 | A * | 12/1999 | Gu | 345/690 |
| 6,094,185 | A * | 7/2000 | Shirriff | 345/102 |
| 6,323,847 | B1 * | 11/2001 | Kaneko et al. | 345/204 |
| 6,345,111 | B1 * | 2/2002 | Yamaguchi et al. | 382/118 |
| 6,400,374 | B2 * | 6/2002 | Lanier | 345/630 |
| 6,496,170 | B1 * | 12/2002 | Yoshida et al. | 345/87 |
| 6,624,828 | B1 * | 9/2003 | Dresevic et al. | 345/771 |

* cited by examiner

*Primary Examiner*—Kee M. Tung
*Assistant Examiner*—Po-Wei Chen
(74) *Attorney, Agent, or Firm*—Burns, Doane, Swecker & Mathis, LLP

(57) ABSTRACT

A method and apparatus is described for providing a consistent visual appearance of pixels of a display screen with respect to a viewing position. Variations between perceived pixel level values associated with the pixels and corresponding pixel level values may be compensated for. Variations are associated with a viewing angle between pixel location and the viewing position and compensated for by applying a respective different correction factor to each of the corresponding pixel level values based on a respective viewing angle. Accordingly different non-linear correction curves corresponding to locations may be established relating a range of pixel level values to a corresponding range of corrected pixel level values associated with the viewing position. A calibration pattern may be further be displayed and user inputs associated with locations received responsive to calibration pattern. Viewing position and non-linear correction curves may thereby be established for locations relative to the viewing position and based on user inputs. User inputs are stored with an association to a user identity. A user input is processed to obtain user identity and stored user inputs and viewing position and non-linear correction curves established based on the user inputs. Change is detected in a relative orientation between a display orientation and the viewing position and a second respective different correction factor applied to each corresponding pixel level value based on the change. Second different non-linear correction curves are established relating pixel level values to corrected values associated with relative orientations. Interpolation or an analytical function is applied to arrive at corrected pixel values. To detect changes, one or more sensors are read. A viewing position sensor senses the position of a remote device coupled to the viewer. The viewer feature tracking sensor includes a camera and means for analyzing an image for features associated with the viewer.

49 Claims, 10 Drawing Sheets

METHOD AND APPARATUS FOR CORRECTING PIXEL LEVEL INTENSITY VARIATION

BACKGROUND

The present invention relates to computer graphics processing. More particularly, the present invention relates to operator interface processing, and selective visual display.

While the cathode ray tube (CRT) still accounts for a large percentage of the market for desktop displays, LCD (liquid crystal display) monitors are expected to account for a growing percentage of monitor sales. Continued widespread, if not exclusive use of LCD monitors in portable computers in addition to the growing use of LCD monitors on the desktop has fueled recent developments in display technology focusing on, for example, conventional LCD and TFT (thin-film transistor) flat-panel monitors. Further fueling the expanded use of LCD and related display technologies is a continuing drop-off in price over time.

LCD flat-panel displays have obvious advantages over desktop CRTs. For example, LCDs are generally thinner thus requiring less space, and relatively lighter, e.g. 11 lbs vs. as much as 50 lbs or even more. Due to light weight and small form factor LCD displays can be flexibly mounted in relatively small spaces. Moreover, LCD displays use nearly 75 percent less power than CRTs. Other advantages of LCD displays include the elimination of, for example, flicker, and edge distortion.

There may also however be certain problems and disadvantages associated with LCD displays. LCD displays, for example, are generally far more expensive than CRT displays. Since LCD displays often incorporate different technology in a similar form factor package, selection of the most effective technology can be challenging. A related problem with LCD displays is the data format. Most LCD displays are directly compatible with conventional analog, e.g. RGB, video graphics controllers. Some newer "digitial" LCD displays however require digital video graphics controllers having, in some cases, a proprietary output signal and proprietary connector.

Aside from compatibility issues quality issues may arise. Many contemporary LCD displays use so-called active-matrix TFT technology which generally produces a high quality display picture. Some LCD displays on the market however continue to be sold with older, passive-matrix technology, which, while generally being offered in a thin form factor, and at relatively low price, suffers from poor quality. In some cases, LCD displays are considered to be grainy and difficult to view for extended periods. Poor viewing quality in an LCD display may further result from many other factors, such as slow response time, and dimness. However, the picture quality of a typical LCD display, whether passive-matrix, active-matrix, or the like, often suffers most greatly because of the narrow viewing angle inherent in the LCD display technology. Viewing problems arise primarily due to the structure of the LCD display elements themselves along with the uniform application of intensity settings generally applied as a uniform voltage level to all pixels, which produce viewing anomalies that affect viewing quality. It should further be noted that while LCD technology conveniently illustrates problems which may arise as described herein, similar problems may arise in display technologies having similar characteristics, or whose characteristics give rise to similar problems, as will be described in greater detail hereinafter with reference to, for example, FIG. 3A and FIG. 3B.

Thus, one important problem associated with LCD displays is the dependency of image quality on the relative angel between the viewing axis and the display axis, or simply, the viewing angle as illustrated in FIG. 1A. Desktop LCD display 100 may be set at some initial angle on a desktop such that display unit surface 110 is preferably in coplanar alignment with plane 111 as seen from a side view. Accordingly, a viewing position 120 may result in a series of relative viewing angles θ0 121, θ1 122, and θ2 123 between viewing position 120 and various points on display unit surface 110 relative to plane 111. Problems may arise associated with image quality at various viewing angles θ0 121, θ1 122, and θ2 123 such that portions of an image displayed on an LCD display may appear different at points on display unit surface 110 corresponding to viewing angles θ0 121, θ1 122, and θ2 123 relative to an observer at a fixed viewing position 120.

In addition, as illustrated in FIG. 1B, to an observer positioned differently at, for example, viewing position 130, a different set of viewing angles θ0' 131, θ1' 132, and θ2' 133 may cause an image on display unit 110 to appear still differently. It should further be noted that the various viewing angles are dependent on the size of display unit surface 110. For example, if display unit surface 110 is extended to include for example screen position 140, an image portion occupying screen position 140 will be observed from viewing position 130 at a viewing angle θ3 141 and the image portion may appear differently even though there is no change in display orientation.

Similar problems arise in portable or notebook computer system 200 as illustrated in FIG. 2. Notebook computer system 200 may generally include a base part 230 and a movable display part 210. As can be seen in FIG. 2, display part 210 can be tilted through a range of display orientations θ0 211, θ1 212, and θ2 213 resulting in a corresponding range of viewing angles δ0 221, δ1 222, δ2 223 relative to viewing position 220. An image presented on display part 210 will look different if the display orientation changes even when an observer maintains the same viewing position 220. Such situations may typically arise when a notebook computer system 200 is first opened and display part 210 is moved to its initial position, or when the angle associated with display part 210 angle is adjusted. As a consequence the same pixel level intensity setting will be observed differently from the same viewing position 220 as display part 210 is tilted through different angles, such as, for example, θ0 211, θ1 212, and θ2 213. It should be noted that viewing angles δ0 221, δ1 222, δ2 223 may represent either the respective angles between the plane of display part 210 or a normal to the plane of display part 210 and a line connecting the center of display part 210 with an observer's eye at viewer position 220. Since both viewing angle and display orientation are proportional they may be used interchangeably to describe, for example, tilt angle. It should be noted that for a range of fixed intensity settings each individual pixel may have a different response characteristic throughout the range of intensities based on its position with respect to the viewing position. Thus prior art approaches to tilt angle compensation, which have applied fixed intensity to all portions of the screen are still not ideally suited to correction for all pixel leves values based on a fixed viewing position and associated display orientation. Complications arise for color display systems using, for example, RGB color quantization. In such color displays, RGB composite colors at each intesity setting in the range of intensity settings possible for the disaply may be derived and rendered based on relative intensities between Red, Green, and Blue pixel components.

Accordingly, for a given intensity setting, intensity variations and color distortion may occur based on viewing angle for a given pixel position with respect to viewing position. It should further be noted that as intensity settings change, color variations may be non-linear, e.g. color distortion associated with a given pixel may change throughout the range of intensity settings.

With reference to FIG. 3A, it can be observed in greater detail how, for example, orientation direction 320 with respect to normal 310 of elements 305 associated with exemplary display 300 affects the level intensity from different portions 301, and 302 of display 300 perceived, for example, at viewing position 330. It can be seen that thick arrow 340 represents a relatively high level of perceived intensity from display portion 301 corresponding to a high degree of alignment between orientation direction 320 and a line between display portion 301 and viewing position 330. Thin arrow 341 represents a relatively low level of perceived intensity from display portion 302 corresponding to a relatively low degree of alignment between orientation direction 320 and a line between display portion 301 and viewing position 330. FIG. 3B illustrates a different orientation direction 350 with respect to the same viewing position 330. It can be seen that thick arrow 360 represents a relatively high level of perceived intensity from display portion 304 corresponding to a high degree of alignment between orientation direction 350 and a line between display portion 304 and viewing position 330. Thin arrow 361 represents a relatively low level of perceived intensity from display portion 303 corresponding to a relatively low degree of alignment between orientation direction 350 and a line between display portion 303 and viewing position 330. FIG. 3B represents a problem associated with prior art intensity adjustments. In prior art display systems adjustments may be applied uniformly to display elements affecting, for example, a global alignment as illustrated by orientation direction 350 of display elements 305. While such adjustments may improve perceived pixel intensity for areas of a display which were previously obscured, other portions of the display which were relatively bright may become dim after adjustment.

Attempts that have been made to reduce the dependency of the perceived intensity of LCD displays on viewing angle. By using different display technology, for example, in plane switching (IPS) technology better viewing angles may be obtained than by using the more traditional twist nematic (TN) or super twist nematic (STN) technology, however IPS technology is less desirable since it is more expensive than TN technology. Other approaches include coating the display surface with a special layer which then acts as a spatially uniform diffuser. None of these prior art solutions however attempt to correcting an image signal to compensate for viewing angle differences before being displayed.

Thus, it can be seen that while some systems may solve some problems associated with adjusting image intensity, the difficulty posed by, for example, handling different viewing angles without resorting to more expensive technology or screen coatings remains unaddressed.

It would be appreciated in the art therefore for a method and apparatus for compensating for pixel level variations which arise due to changes in viewing angle.

It would further be appreciated in the art for a method and apparatus which automatically corrected for pixel level variations throughout a range of intensity settings.

It would still further be appreciated in the art for a method and apparatus which automatically corrected individual RGB components for pixel level variations throughout a range of intensity settings.

It would still further be appreciated in the art for a method and apparatus which automatically corrected for pixel level variations in a variety of display technologies including but not limited to LCD display technology.

SUMMARY

A method and apparatus for correcting pixel level variations is described for providing a consistent visual appearance of one or more pixels of a display screen with respect to a viewing position. Accordingly, variations between perceived pixel level values and corresponding pixel level values, e.g. actual pixel level values as assigned by a graphics controller or as stored, for example, in a frame buffer, may be compensated for. It is important to note that variations may be associated with viewing angles between pixel locations and the viewing position and viewing position may be the actual viewing position as determined by, for example, a sensor, or viewing position as established based on known average viewing position or a standard viewing position as would be described in a user manual or the like.

Thus in accordance with one exemplary embodiment of the present invention, the viewing position may be established by any of the above described methods. A respective correction factor, which is preferably different for each pixel, may be applied to each of the corresponding pixel level values based on respective viewing angles associated with each pixel location and the established viewing position. The different correction factors may be applied to each pixel based on establishing different non-linear correction curves corresponding to the locations of each pixel. It will be appreciated that the different non-linear correction curves relate to range of possible pixel level values, e.g. 0 to 255 for an 8-bit gray scale image, to a corresponding range of corrected pixel level values associated with the viewing position. As will be described in greater detail hereinafter, the non-linear correction curves preferably adjust the mid-level pixel values to corrected mid-level pixel values, while keeping the end values the same. It should be noted however that end values may also be changed without departing from the scope of the invention as contemplated herein.

In another exemplary embodiment, a calibration pattern may be displayed on the display screen and user inputs may be received associated with pixel locations. The user inputs may be in response to the display of the calibration pattern. For example, the calibration pattern may be displayed in various parts of the display and user input received for each part of the display and the like. Thus the viewing position may be established through the calibration process and non-linear correction curves established for the pixel locations relative to the established viewing position and, again, based on the received user inputs. The user inputs may further be stored with an association to a user identity. When a user input such as, for example, a user login or the like, or any user input from which a user identity may be associated, is then processed, the user identity may be obtained along with stored user inputs, e.g. information stored from a previous calibration session or preferences registration, associated with the user identity. The viewing position may then be established along with non-linear correction curves for each pixel location relative to the established viewing position based on the user inputs. Thus, for example, a parent and a child may provide different user inputs for a calibrated and/or preferred viewing position, which user inputs may be stored along with an association to the user identity and those inputs called up during a subsequent user identification process such as, for example, a user login or the like.

In yet another exemplary embodiment a change in a relative orientation between, for example, a particular display orientation and the viewing position may be detected and a second respective different correction factor applied to each of the corresponding pixel level values based on the detected change. Accordingly different non-linear correction curves corresponding to different relative orientations between the display orientation and the viewing position may be established relating the range of pixel level values to corrected pixel level values associated with the relative orientations.

In accordance with various embodiments, correction factors may be applied by determining, for example, if the viewing position and location of each pixel corresponds to a reference location, for example, obtained during a calibration procedure and, if no correspondence is determined, using a first reference location and a second reference location to arrive at an interpolated correction factor. For relative orientation, if the changed relative orientation does not correspond to a reference orientation, a first reference orientation and a second reference orientation may be used to arrive at an interpolated correction factor. It should further be noted that a correction factor may be determined and applied by applying an analytical function to generate the correction factor for correction factors based on pixel location and those based on location and relative orientation.

In accordance with still another exemplary embodiment of the present invention, one or more sensors may be provided to indicate one or more of, for example, display orientation and viewing position. The one or more sensors may include, for example, a display orientation sensor, a viewing position sensor, or a viewer feature tracking sensor. The viewing position sensor, for example, may include a sensor for sensing the position of a remote device coupled to the viewer such as for example, a device attached to a pair if of glasses or the like. The viewer feature tracking sensor, for example, may include a camera for generating an image associated with a viewer, and a means for analyzing the image to track one or more features associated with the viewer such as eye position as could be tracked using image recognition software, or the like running on a processor.

In accordance with alternative exemplary embodiments, one or more reference pixel level values associated with one or more reference pixel locations of the display screen may be measured relative to one of the one or more different viewing positions and a reference display orientation and each value mapped to a corrected pixel level value associated with the one of the one or more different viewing positions and the reference display orientation. Interpolation may be used to obtain corrected values for one or more non reference pixel level values associated with one or more non-reference pixel locations. Each of the pixel level values may be mapped to additional corrected one or more pixel level values associated with corresponding different ones of the one or more viewing positions and the reference display orientation and, after detecting that the one of the one or more viewing positions has changed to a different viewing position relative to the reference display orientation, the pixels may be displayed at the corrected pixel level value associated with the mapping between the additional new pixel level value and the different viewing position and the reference display orientation. In addition, a correction factor may be applied to a remaining one or more non-reference pixel level values based on a relative location between the remaining one or more non-reference pixel level values and the one or more reference pixel locations. Alternatively, an analytical function may be applied to the remaining one or more non-reference pixel level values.

BRIEF DESCRIPTION OF THE DRAWINGS

The objects and advantages of the invention will be understood by reading the following detailed description in conjunction with the drawings, in which.

DETAILED DESCRIPTION

Figure 1A:
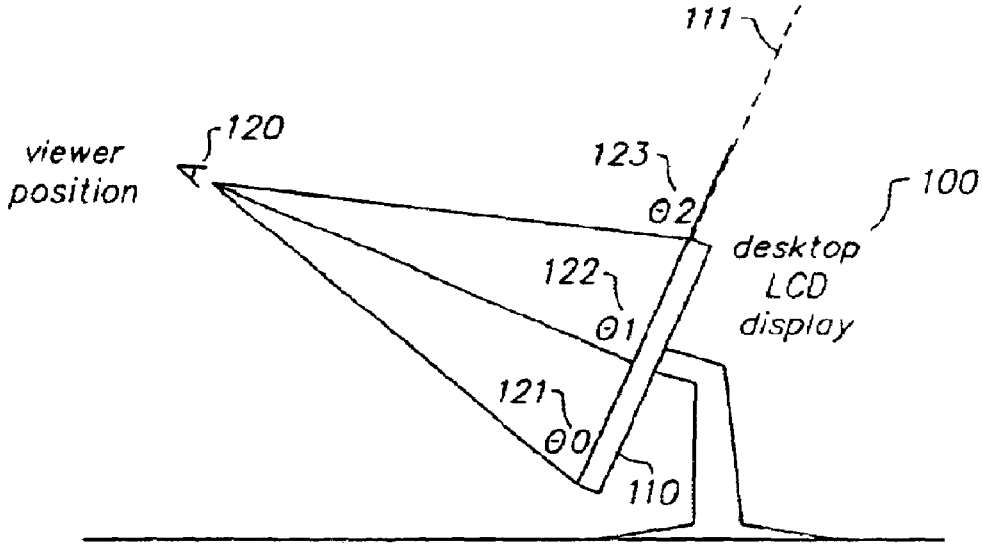
FIG. 1A is a diagram illustrating an exemplary desktop LCD display and a viewing position.
Figure 1B:
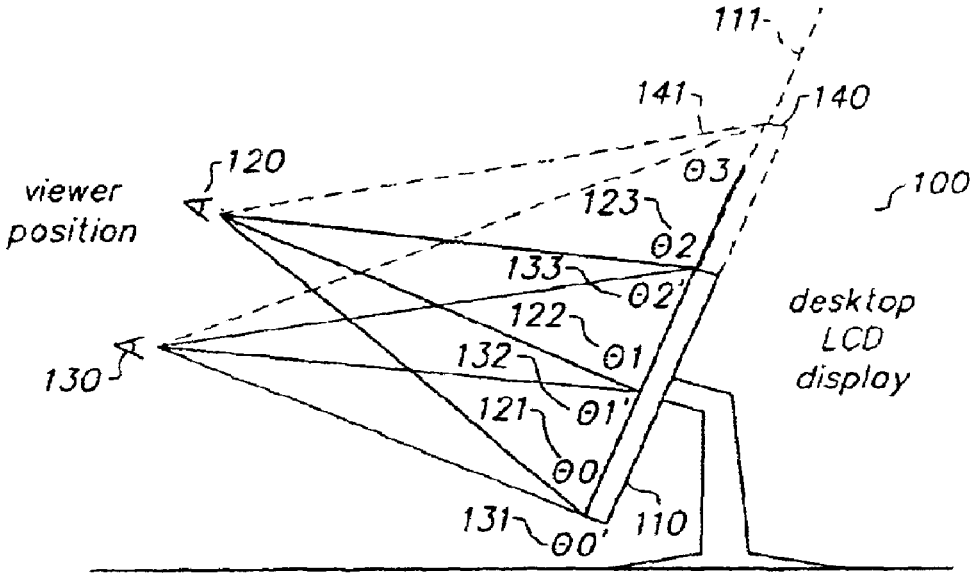
FIG. 1B is a diagram illustrating an exemplary desktop LCD display and different viewing positions.
Figure 2:
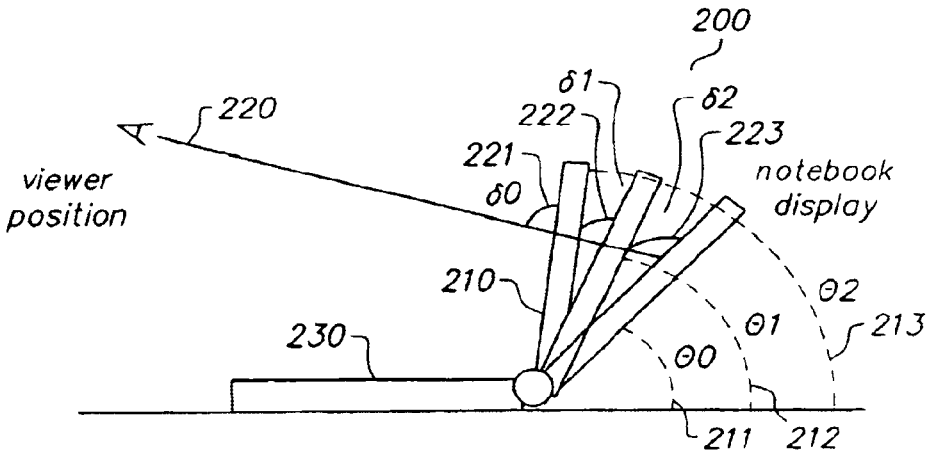
FIG. 2 is a diagram illustrating an exemplary notebook LCD display and different display orientation positions.

The various features of the invention will now be described with reference to the figures, in which like parts are identified with the same reference characters.

Therefore in accordance with exemplary embodiments of the present invention, a system and method are provided for correcting pixel level variations. Such a system and method may be associated, for example, with a software module incorporated into, for example, a graphics controller, display driver or the like commonly used for computer displays or incorporated into a computer operating system or running as a separate application.

Figure 4:
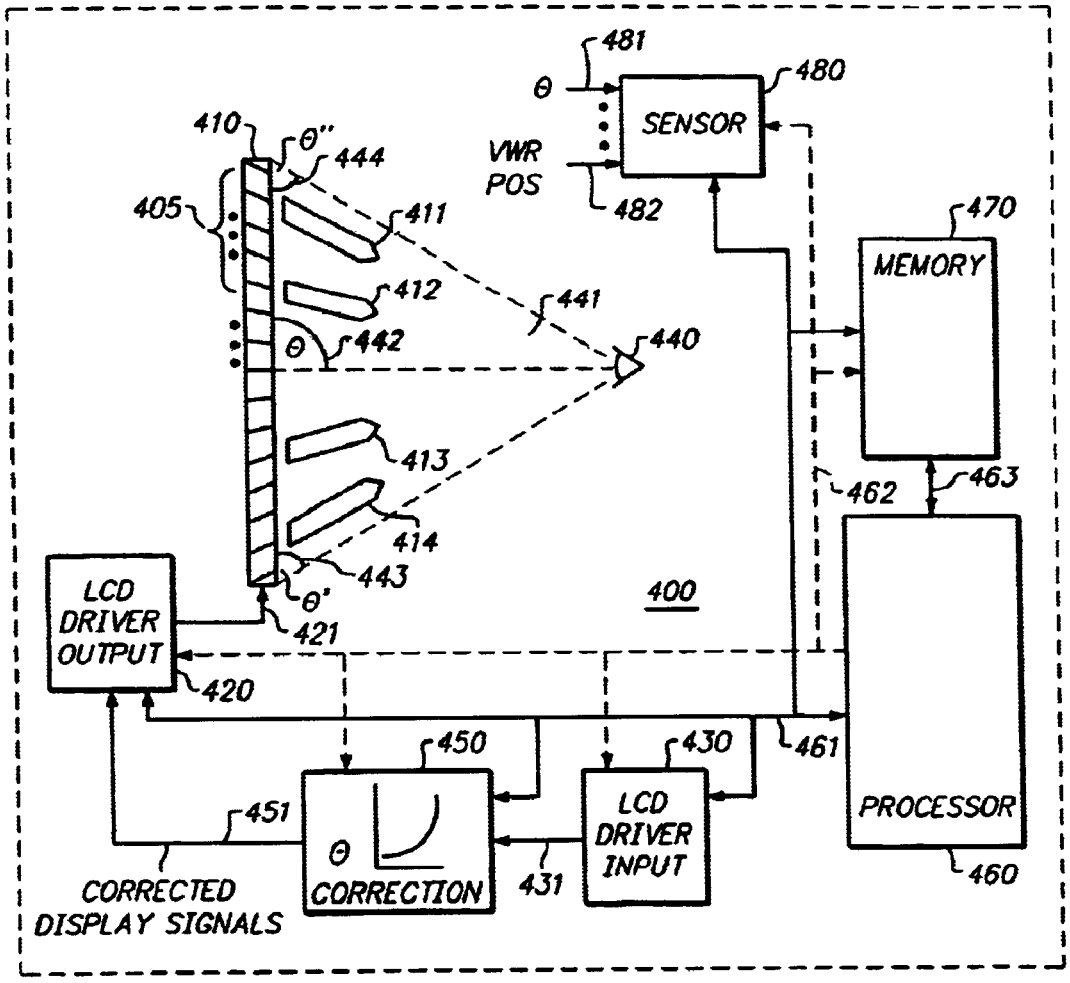
FIG. 4 is a diagram illustrating an exemplary display and a correction curve applied in accordance with an exemplary embodiment of the present invention.

As can be seen in FIG. 4, a computer display system 400 is illustrated including display surface 410, LCD driver output section 420, LCD driver input section 430, correction module 450, processor 460, and memory 470. LCD driver input section 430 may receive display signals 431, for example from a graphics application running on processor 460, or may generate them based on graphics information generated from an application and may include a frame buffer or the like. Display signals 431, which may be considered "raw", that is, uncorrected and likely to be distorted based on viewing angle as previously described, may be transferred to correction module 450. It should be noted that correction module 450 may contain one or more correction curves corresponding to different portions of display surface 410 as will be described in greater detail hereinafter. Correction curves may be stored in memory 470 or locally in, for example, a resident memory module (not shown) which is incorporated into correction module 450. It should also be noted that correction curves may be generated by an analytic function which may be stored in memory 470 or which may be programmed, for example, to run on processor 460. Pixel display signals 431 may be operated upon by correction module 450 to produce a corrected set of display signals 451 to be output to LCD driver output section 420. Correction may be accomplished preferably using, for example, look up tables or modified pallets which may be sorted in memory 470 and indexed based on one or more uncorrected pixel values and may further be associated with one or more correction curves, or alternatively correction may be accomplished using real time correction processes which may be, for example, in the form of software processes executing on processor 460 or a local processor associated with correction module 450. LCD driver 420 may generate actual device display signals 421 which drives individual display elements 405 of display surface 410. It should further be noted that display elements 405 may be any one of a variety of display technologies such as, for example, twist nematic (TN) technology or the like LCD technology as is now or will be known and used in the art. It should still further be noted that while correction module 450 is illustrated as being positioned between LCD driver input 430 and LCD driver 420 it may be implemented in a number of alternative positions within computer system 400 for generating corrected display signals. For example, correction module 450 may be placed after LCD driver 420, or between LCD driver 420 and individual display elements 405. Alternatively, correction module 450 may be placed prior to LCD driver input 430 wherein correction values may be generated, for example in an application running within the computer's operating environment. Alternatives for correction module 450 may, depending on its placement within the system, include but are not limited to implementation in hardware as part of, for example, a graphics adapter, partial implementation in hardware and partial implementation in embedded software, software implementation within an operating system or in an application designed for execution within the operating environment of, for example, a notebook computer.

In the example illustrated in FIG. 4, display surface 410 is at a 90° viewing angle 442 with respect to viewer position 440 and a line 441 drawn therebetween. Values associated with correction module 450 may be applied based on viewing angle 442 which results in a predetermined distribution of orientations associated with display elements 405. Accordingly, arrows 411, 412, 413 and 414 correspond to a uniform perceived intensity at viewing position 440 despite relative differences in the viewing angles as represented by Θ' 443 and Θ" 444. Accordingly, based on the application of values in correction module 450 to display elements 405, pixel level variations may be largely eliminated and intensity levels made uniform with respect to viewer position 440. It should be noted that, in accordance with various embodiments of the present invention one or more sensor inputs may be provided by sensor module 480. For example, input 481 from a display orientation sensor, to be described in greater detail hereinafter, may be pre-processed if necessary and provided to processor 460 to automatically update correction information. Further, other input, for example, input 482 from a sensor which tracks a viewer position—also to be described hereinafter, may be provided to processor 460 to allow correction information, such as correction curves, to be updated based on a new viewer position. It may also be appreciated that pixel level correction in accordance with the present invention may be provided without sensor input. For example, average value assumptions associated with viewing position, display orientation, and the like may be used to arrive at a set of corrected pixel values without sensor input, which corrected values may then be asserted.

Figure 5A:
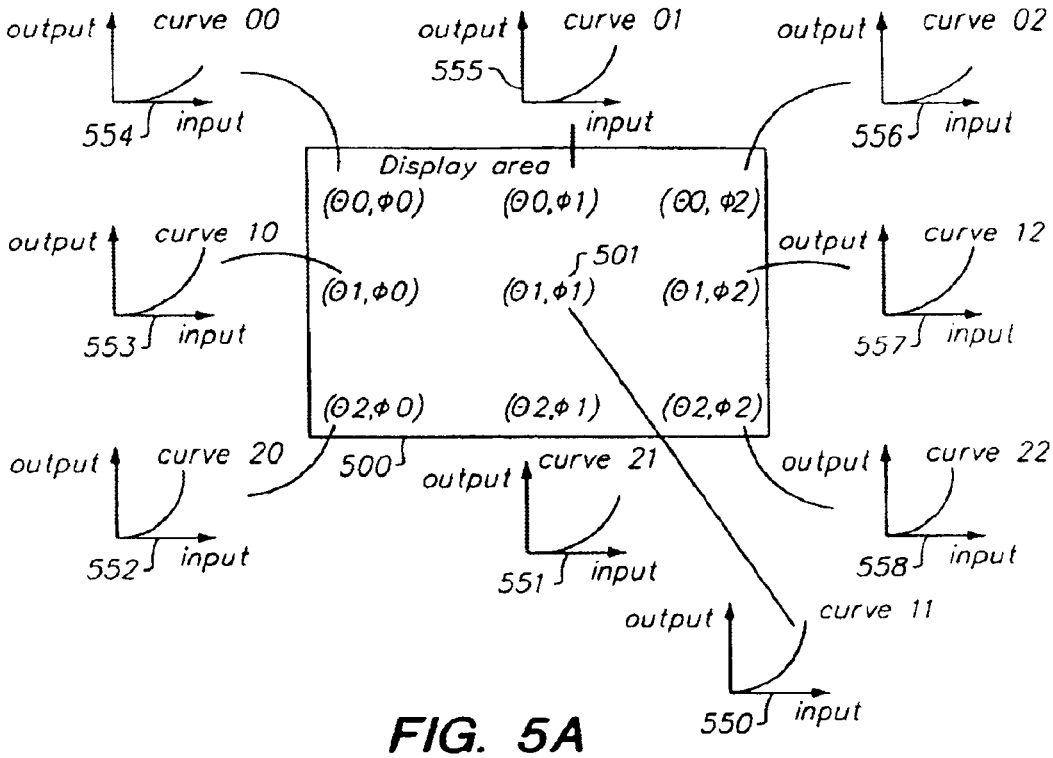
FIG. 5A is a diagram illustrating a front view of an exemplary desktop LCD display and correction curves in accordance with an exemplary embodiment of the present invention.
Figure 5B:
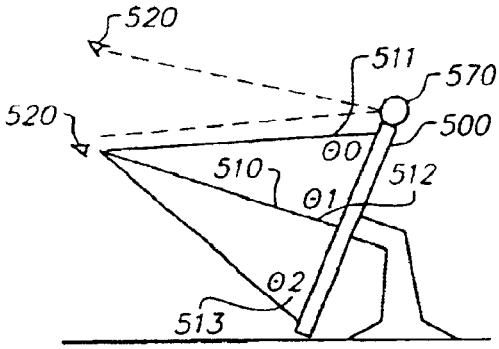
FIG. 5B is a diagram illustrating a side view of an exemplary desktop LCD display in accordance with an exemplary embodiment of the present invention.

In order to perform corrections as described with reference to correction module 450, it is preferable to construct a series of curves as illustrated in FIG. 5A for different portions of, for example, screen 500. Starting from a center position 501, curve 550 may be constructed representing the correction factors to be applied to input values to create output values for display 500. Curves 551–558 corresponding to various positions on display 500 may be constructed during, for example, a calibration procedure where a user may provide interactive feedback. Alternatively, curves generated based on assuming average values for viewing position, display orientation and the like, may be provided in the event a calibration procedure is not selected by a user or when no calibration procedure is available. It is important to note that, in the exemplary case of 8-bit gray scale rendering from, say, 0 to 255 representing white to black respectively, the mid-level or 50% gray value is preferably used to "calibrate" correction, since the range of mid-level values are most likely to be distorted based on pixel location and resulting viewing angle. Thus correction curves 551–558, for example, will represent the non-linear shift of actual mid-level gray values normally centered at, say, a value of 128 to new mid-level value. The shifted mid-level center value may correspond to whatever value results in a perceived mid-level center value, e.g. 50% gray, at the associated pixel location or screen position. It is important to note that endpoints, e.g. 0 and 255 or 1% and 100%, are preferably not shifted. Accordingly, curves corresponding to various screen positions on display 500 relative to viewing position 520 as illustrated in FIG. 5B may be constructed to compensate for intensity variations based on pixel location. For example, initial position 501 may correspond to line 510 normal to display 500 with respect to viewing position 520 while different curves may be constructed for different locations on display 500 corresponding to viewing angles 511 and 513. With reference to the top view provided in FIG. 5C, different side to side viewing angles 531, 532 may be compensated for with different curves as described hereinabove with reference to FIG. 5A.

Figure 5C:
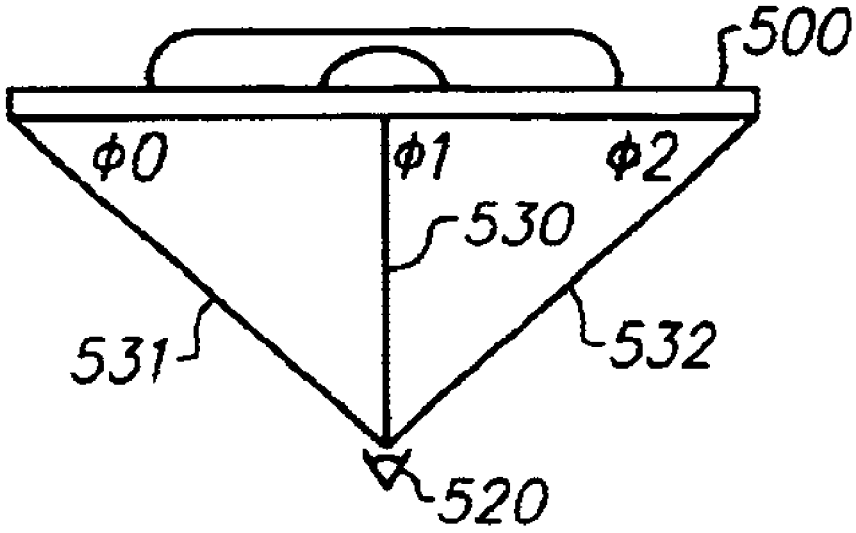
FIG. 5C is a diagram illustrating a top view of an exemplary desktop LCD display in accordance with an exemplary embodiment of the present invention.
Figure 6A:
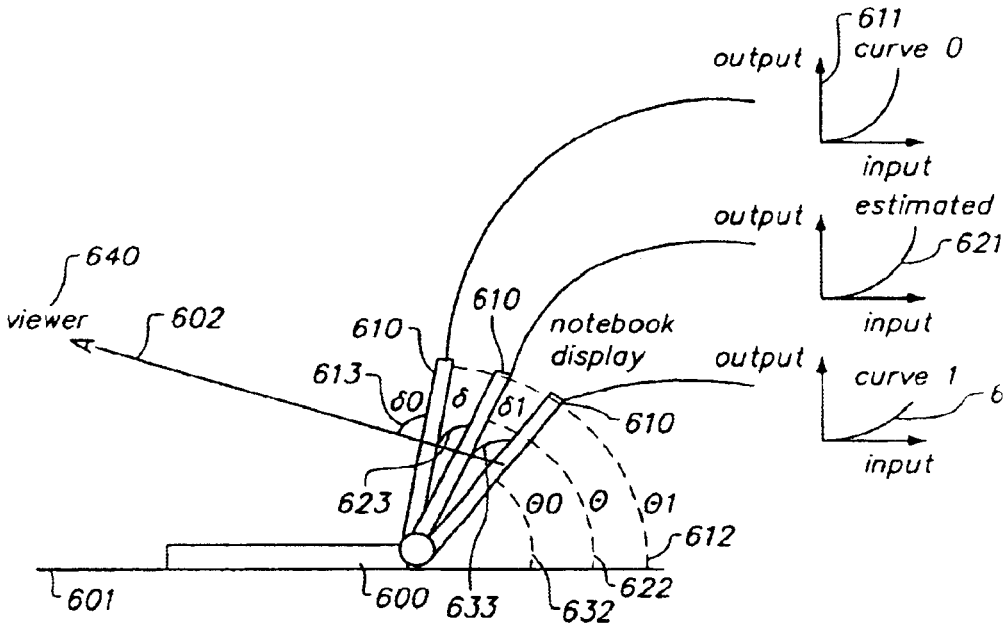
FIG. 6A is a diagram illustrating a side view of an exemplary notebook LCD display and correction curves in accordance with an exemplary embodiment of the present invention.
Figure 6B:
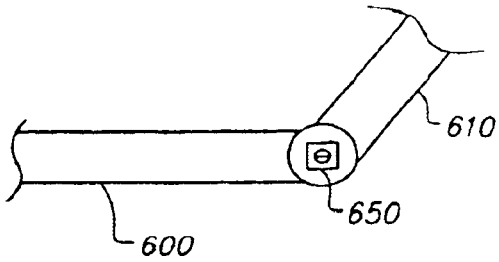
FIG. 6B is a diagram illustrating a side view of an exemplary notebook LCD display and exemplary display orientation sensor in accordance with an exemplary embodiment of the present invention.

While correction curves as described herein above with reference to FIGS. 5A, 5B, and 5C may be useful to correct for intensity variations based on pixel location or screen position for a fixed viewing position and display orientation, additional correction curves may be provided for each pixel location that compensate for variations in display orientation as illustrated in FIG. 6A. With respect to viewer position 640, notebook computer 600 may be moved into different orientations such that display part 610 forms different orientations with respective viewer position 640. It can be seen that for example display orientations Θ0 632 Θ 622 and Θ1 612 may be formed between display part 610 and surface 601 and corresponding display orientations Δ0 613, Δ 623 and Δ1 633 may be formed between the plane of display 610 and line 602 representing a line of sight of viewer position 640. It should be noted that for example display orientations Θ0 632 and/or Δ0 613 as well as display orientation Θ1 612 and/or Δ1 633 may correspond to known correction curves 611 of 631 respectively. In accordance with one exemplary embodiment of the present invention, intermediate position of display part 610 represented by, for example display orientations Θ 622 and/or Δ 623, may be estimated as in curve 621 through interpolation or similar mathematical methods. As further illustrated in FIG. 6B, display orientation can be measured automatically by, for example, sensor 650, which may preferably be mechanical, electromechanical, electro-optical or the like which input, proportional to display orientation, may be provided to processor 460. Accordingly, using input from display orientation sensor 650, correction curves associated with various display orientations may be calculated or retrieved automatically as new-sensor input is provided corresponding to new display orientations. It should further be noted that in the absence of sensor input, correction curves associated with new display orientations may be established by, for example, the invocation of a calibration process by a user, or the like, which may either be used to generate new correction curves or provide an indication of display orientation which will allow a stored set of correction curves to be retrieved.

Figure 7B:
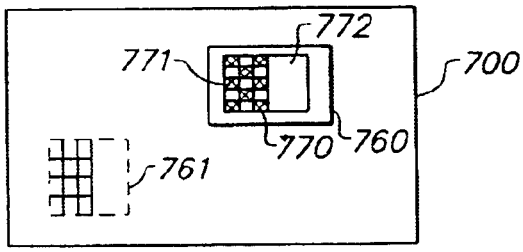
FIG. 7B is a diagram illustrating a front view of an exemplary LCD display area using a test image in accordance with an exemplary embodiment of the present invention.
Figure 7C:
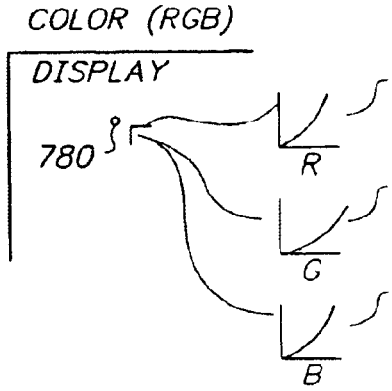
FIG. 7C is a diagram illustrating a front view of an exemplary LCD color display with individual correction curves for each color component in accordance with an exemplary embodiment of the present invention.
Figure 3A:
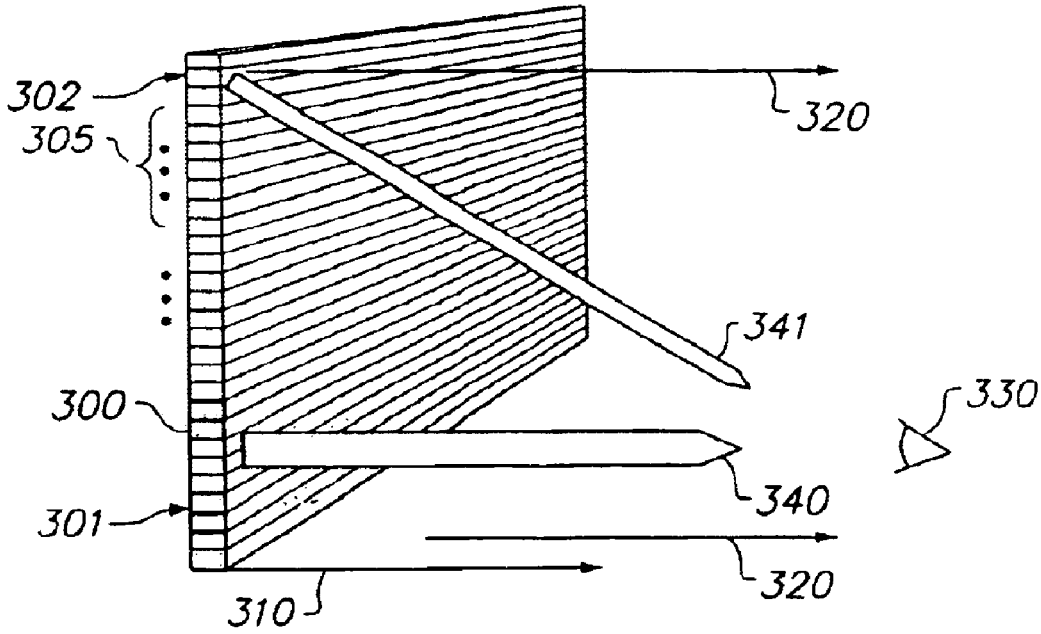
FIG. 3A is a diagram illustrating an exemplary normal orientation of display elements.
Figure 3B:
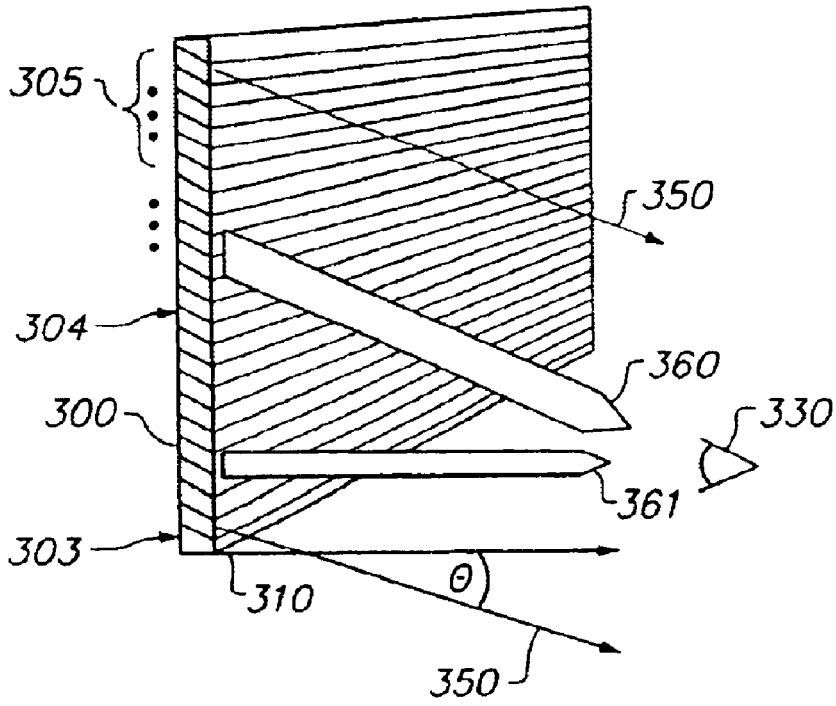
FIG. 3B is a diagram illustrating an exemplary angled orientation of display elements.
Figure 7A:
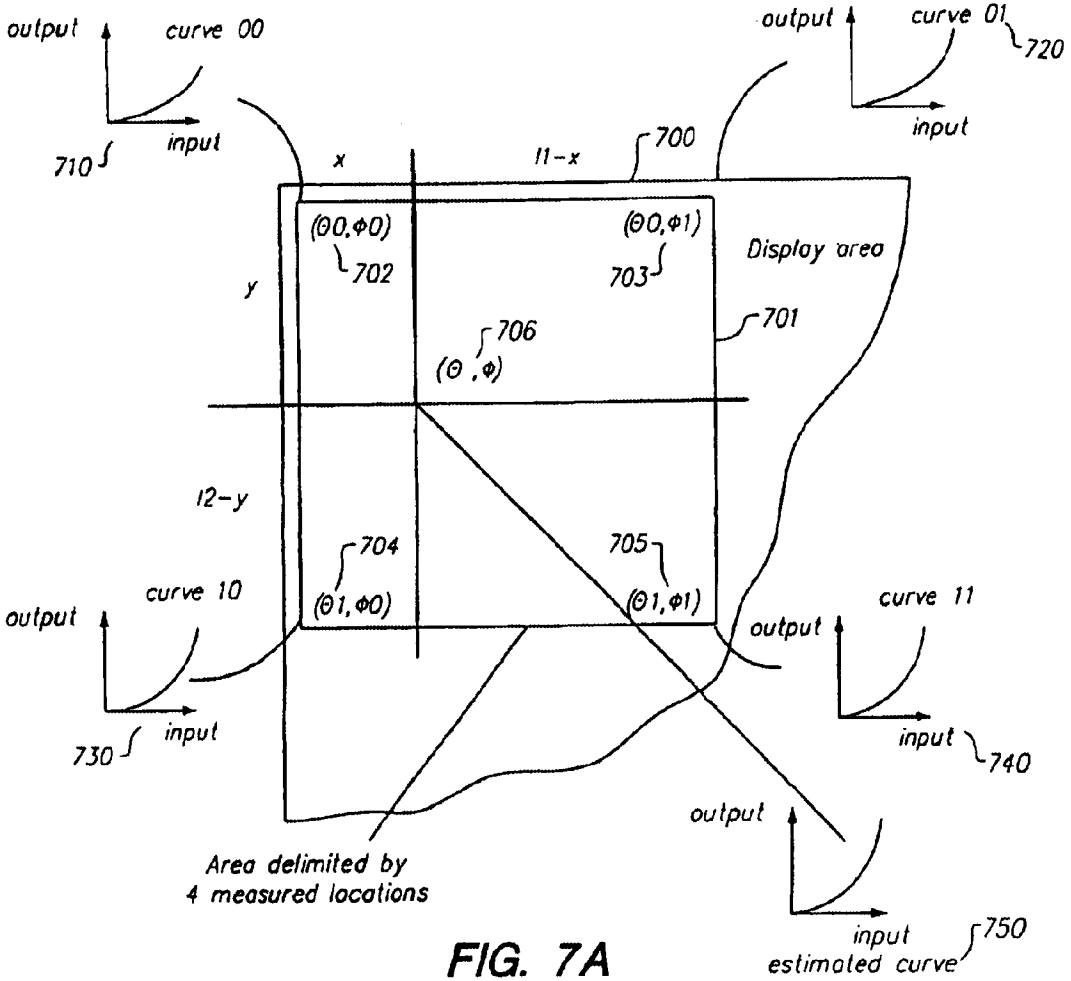
FIG. 7A is a diagram illustrating a front view of an exemplary LCD display area section and an estimated correction curve in accordance with an exemplary embodiment of the present invention.

It should be noted that while interpolation, as described herein above, may be used to arrive at correction curves for intermediate display orientations, interpolation may further be used to arrive at correction curves for intermediate screen positions between screen positions having known correction curves associated therewith as illustrated in FIG. 7A. Therein it can be seen that area 701 of display area 700 may be delimited by four measured locations corresponding to location 702, 703, 704 and 705. Correction curves 710, 720, 730 and 740 may further correspond to measured locations 702–705 respectively. Thus, when an arbitrary non-measured point, e.g., arbitrary pixel position 706 must be corrected estimated curve 750 may be used to correct for pixel level variations corresponding to arbitrary pixel position 706. It should be noted that because it is impractical to measure each pixel value associated with display area 700, pixel values, for example, in reference locations 702–705 may be measured, and a method may be used to derive the correction value for arbitrary pixel position 706. Such method may include, for example, an interpolation procedure between arbitrary pixel position 706 and measured reference locations 702–705 to arrive at a correction value which may then be applied to arbitrary pixel position 706; or may include an analytical function which may be applied to arrive at a correction value for arbitrary pixel position 706 depending on the size of display area 700 and the viewing distance. It will be appreciated that the form of analytical function may be derived, for example, using a curve fitting method using the measured correction factors in the reference locations. It should be noted that correction values applied to display area 700 are preferably for a particular screen angle. If the display orientation is changed, new correction values may be applied in accordance with the above description. A series of measured pixel values may be stored, for example, in memory 470, for different display orientations and, in accordance with the description associated with FIG. 6, values associated with intermediate display orientation may be interpolated or alternatively may be arrived at using a deviation from stored correction factors associated with predetermined display orientations, or may be calculated using an analytic function as previously described.

It should be apparent that to obtain a uniform pixel level appearance over display area 700, the object of a pixel correction method in accordance with the present invention is to apply a different correction factor to every pixel of the screen such that pixels appear at a level similar to the pixel in the center of the screen as viewed from a particular viewer position. Because each pixel of the screen is seen under different viewing angle from a fixed viewer position, correction in accordance with the present invention may be achieved, for example, by constructing correction curves or maps of pixel level correction values for each pixel of display area 700. To create a map for each pixel location, a few pixel locations such as, for example, locations 702–705 may be mapped and the map for any remaining arbitrary locations, such as for example, location 706, may be interpolated as described above.

In another method, as illustrated in FIG. 7B, several pixel locations may be calibrated or mapped using test image 770, half of which may be formed of an exemplary checkerboard pattern 771 using black and white pixels and half of which is formed of, for example in the exemplary 8-bit gray scale case, a mid-level or 50% gray level 772. It should be noted that while the foregoing checkerboard pattern 771 and gray level 772 configuration may provide a measurable indication of perceived intensity for different locations of display area 700, other patterns may also be used with effectiveness in accordance with the present invention. The size of test image 770 should preferably be small enough such that the pixel level variations with the viewing angle are negligible within the image, but not negligible within display area 700. Test image 770 may be displayed in a window such as test window 760. Test window 760 may further be moved on display area 700 in different positions, such as position 761. In each position, difference between checkerboard pattern 771 of test image 770 and gray level 772 varies. For each position 761, a gray level value may be found for gray level 772 that will result in a perceived match with checkerboard pattern 771. Depending on the position on display area 700, the gray level values which match will be different. It is important to note that the gray level value which matches depends on the gamma correction for the particular display, which can be set in advance.

As an example, 9 positions may be chosen on an arbitrary display area, where a test window is placed. The 9 positions may correspond to a 3×3 regular grid, with the middle position corresponding to the center of the display area, and the other positions as close as possible to the outer borders of the display area.

For each position, a correction factor associated with the gray level value arrived at in the test image may be derived such that by placing the test window in each of the 9 positions, a match can be obtained between the two halves of the test image. For example, for a PowerBook® G3 series computer, of the kind made by Apple Computers, Inc. of Cupertino Calif., with no gamma correction, correction factors may be described in the following matrix:

| | | |
|---|---|---|
| .18 | .18 | .19 |
| .28 | .30 | .31 |
| .37 | .38 | .38. |

Using the above correction factors, gray levels in the test image may be corrected to compensate for viewing angle differences for different positions using the following equation:

$$\text{New pixel value } ij = \text{old pixel value } ij * aij, \quad (1)$$

where aij is the element of the correction matrix corresponding to the position of the pixel.

It should be noted that the left column of the above matrix corresponds to the correction on the left side of the screen, the right column corresponds to the right side of the screen, the upper row corresponds to the upper part of the screen, and so on. Once the correction matrix is obtained, correction for any arbitrary position on the screen may be derived from the correction matrix using an interpolation procedure such as, for example, bilinear interpolation. If f00, f01, f10, f11, for example, represent 4 correction values associated with 4 points defining an area includes an arbitrary position needing correction, the interpolated value may be calculated as:

$$f=(1.-ay)*[(1.-ax)*f00+ax*f01]+ay*[(1.-ax)*f10+ax*f11 \quad (2)$$

where ax defines the relative position of the arbitrary point between f00 and f01 and ay defines the relative position of arbitrary point between f00 and f10.

It is of further importance to note that, as illustrated in FIG. 7C, exemplary color pixel 780, which may be, for example, an RGB color pixel in an RGB color display, may be driven by a display driver with separate intensity values assigned to each color component R, G, and B. The relationship between the intensity of each RGB color component determines the perceived color of color pixel 780 for each intensity setting for the display. Thus intensity differences which come about as a function of viewing angle and/or as the intensity settings for the display are varied throughout a range, the corresponding intensities for each color component is not necessarily proportional. It can be appreciated that in order to preserve composite color accuracy throughout the range of intensity settings for the display and/or for a given intensity and a variety of display orientations, it may be necessary to construct individual correction curves 781, 782, and 783 which curves map individual color component intensity values to individual corrected color component intensity values.

Figure 8:
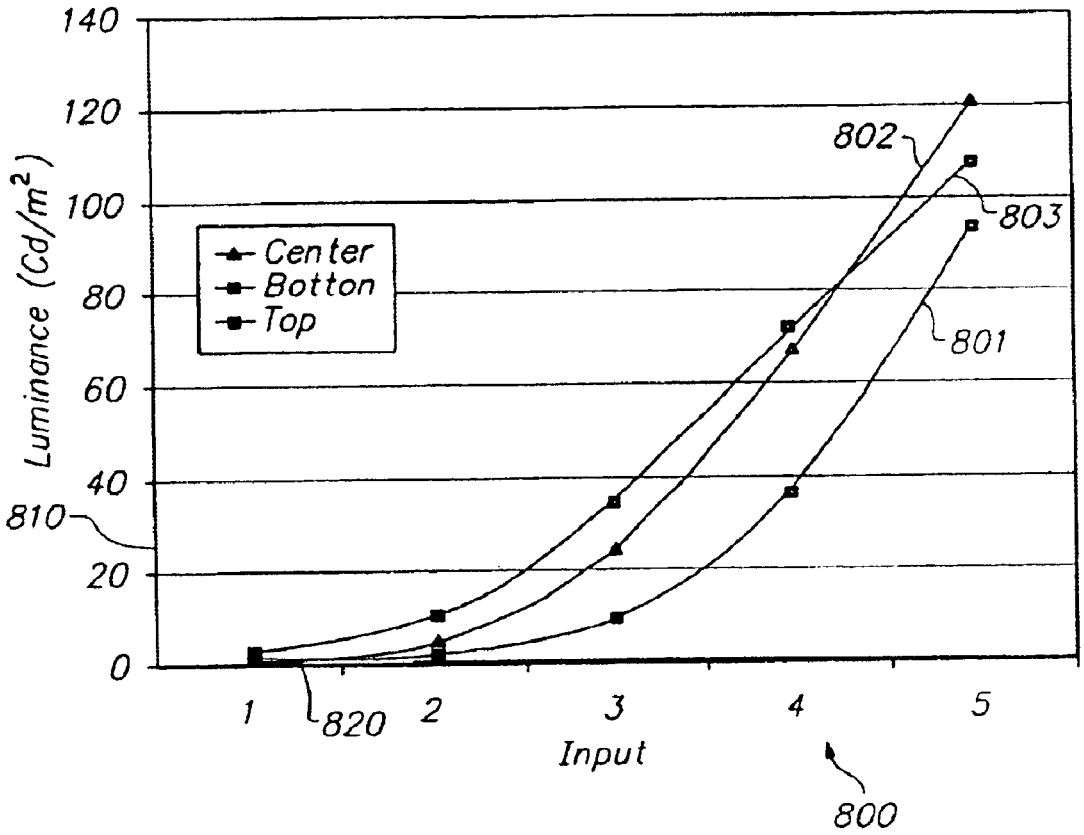
FIG. 8 is a graph illustrating an exemplary family of correction curves in accordance with an exemplary embodiment of the present invention.

To further understand pixel level correction in accordance with the present invention, FIG. 8 illustrates an example of curve variations with respective to changes in viewing angle. Thus, for example, graph 800 shows a measured luminance 810 as a function of input luminance 820 for three different viewer positions 801, 802 and 803 corresponding to top, center, and bottom portions respectively of a display with respect to a fixed viewer position.

Figure 9A:
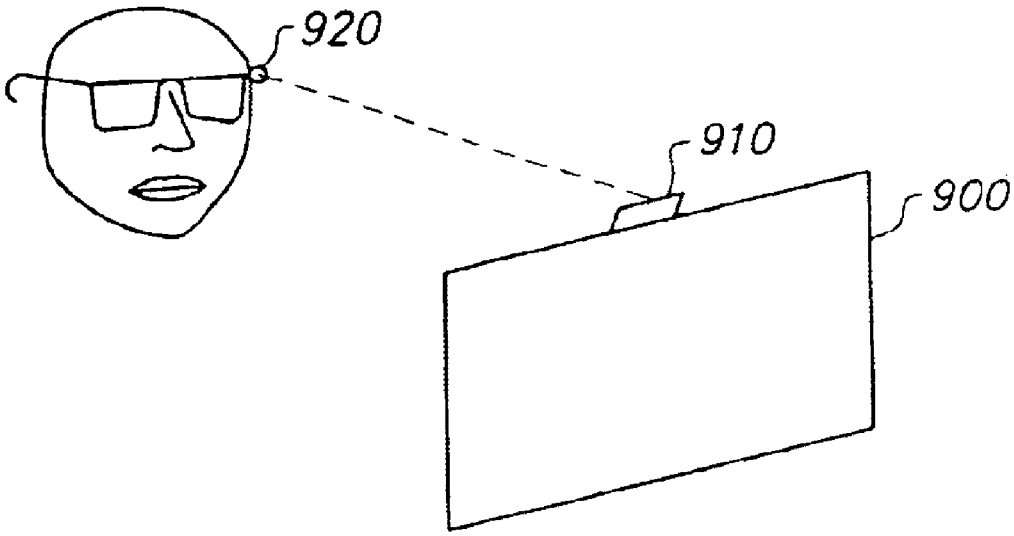
FIG. 9A is a diagram illustrating an exemplary viewer position sensor in accordance with an exemplary embodiment of the present invention.
Figure 9B:
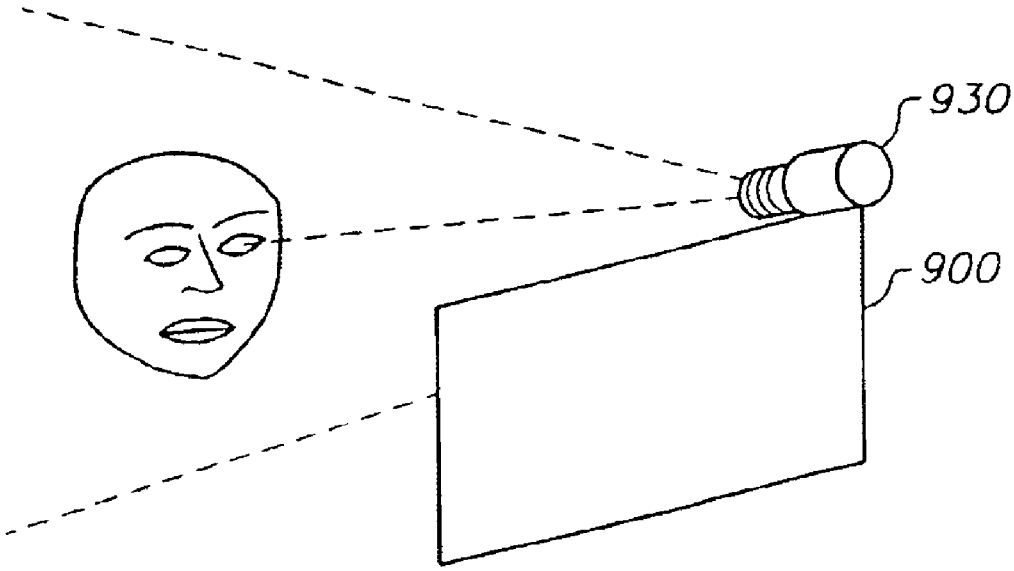
FIG. 9B is a diagram illustrating an alternative exemplary viewer position sensor in accordance with an exemplary embodiment of the present invention.

It should be noted that in accordance with previous descriptions related to sensing viewer position, FIGS. 9A and 9B illustrate measuring viewer position automatically. As can be seen in FIG. 9A, ID device 920 may be affixed in some manner to a user's head via a pair of glasses, for example. Accordingly, motion of ID device 920 with respect to screen 900 may be tracked so as to allow, for example, new correction curves to be loaded corresponding to the new viewer position. Alternatively, as illustrated in FIG. 9B, by using, for example, camera 930 and image recognition software or the like to detect a viewer's eye position, new correction factors may be applied automatically based on new viewer positions.

The invention has been described with reference to a particular embodiment. However, it will be readily apparent to those skilled in the art that it is possible to embody the invention in specific forms other than those of the preferred embodiment described above. This may be done without departing from the spirit of the invention. For example, while the above description is drawn primarily to a method and apparatus, the present invention may be easily embodied in an article of manufacture such as, a computer readable medium such as an optical disk, diskette, or network software download, or the like, containing instructions sufficient to cause a processor to carry out method steps. Additionally, the present invention may be embodied in a computer system having means for carrying out specified functions. The preferred embodiment is merely illustrative and should not be considered restrictive in any way. The scope of the invention is given by the appended claims, rather than the preceding description, and all variations and equivalents which fall within the range of the claims are intended to be embraced therein.

What is claimed is:

1. A method for providing a consistent visual appearance of one or more pixels of a display screen with respect to a viewing position by compensating for variations between one or more perceived pixel level values associated with the one or more pixels and one or more corresponding pixel level values associated with the one or more pixels, the variations associated with one or more viewing angles between one or more locations of the one or more pixels and the viewing position, the method comprising the steps of:

establishing the viewing position based on one or more received user inputs;

applying a respective different correction factor to each of the one or more corresponding pixel level values, the respective different correction factor being based on a respective viewing angle formed between a specific location on the display screen of the one or more pixels and the viewing position;

detecting a change in a relative orientation between a display orientation and the viewing position; and applying a second respective different correction factor to each of the one or more corresponding pixel level values based on the detected chance in the relative orientation.

2. The method of claim 1, wherein the step of applying the respective different correction factor further includes establishing one or more different non-linear correction curves corresponding to the one or more locations, the different non-linear correction curves relating a range of pixel level values to a corresponding range of corrected pixel level values associated with the viewing position.

3. The method of claim 1, wherein the step of establishing the viewing position further includes the steps of:

displaying a calibration pattern on the display screen;

receiving one or more user inputs associated with the one or more locations responsive to the display of the calibration pattern; and establishing the viewing position and one or more non-linear correction curves for each of the one or more locations relative to the established viewing position based on the one or more received user inputs.

4. The method of claim 3, further including the steps of:

storing the received one or more user inputs with an association to a user identity; and processing a user input to obtain the user identity and the one or more stored user inputs associated therewith;

wherein the step of establishing the viewing position further includes the step of establishing the viewing position and one or more non-linear correction curves for each of the one or more locations relative to the established viewing position based on the one or more user inputs.

5. The method of claim 1, wherein the step of applying the second respective different correction factor further includes establishing one or more second different non-linear correction curves corresponding to one or more relative orientations between the display orientation and the viewing position, the second different non-linear correction curves relating the range of pixel level values to a second corresponding range of corrected pixel level values associated with the one or more relative orientations.

6. The method of claim 1, wherein the step of applying the different correction factor further includes the steps of:

determining if the viewing position and a location of the each corresponds to a first reference location; and interpolating using the first reference location and a second reference location to arrive at an interpolated correction factor if the determined location of the each does not correspond to the first reference location.

7. The method of claim 1, wherein the step of applying the second different correction factor further includes the steps of:

determining if the changed relative orientation corresponds to a first reference orientation; and interpolating using the first reference orientation and a second reference orientation to arrive at an interpolated correction factor if the determined changed relative orientation does not correspond to the first reference orientation.

8. The method of claim 1, wherein the step of applying the different correction factor further includes the step of applying an analytical function to generate the different correction factor.

9. The method of claim 1, wherein the step of applying the second different correction factor further includes the step of applying an analytical function to generate the second different correction factor.

10. The method of claim 1, wherein the step of detecting further includes the step of reading one or more sensors indicating one or more of: display orientation and viewing position.

11. The method of claim 10, wherein the one or more sensors include one or more of: a display orientation sensor, a viewing position sensor, a viewer feature tracking sensor.

12. The method of claim 11, wherein the viewing position sensor further includes a sensor for sensing the position of a remote device coupled to the viewer.

13. The method of claim 11, wherein the viewer feature tracking sensor further includes a camera for generating an image associated with a viewer, and a means for analyzing the image to track one or more features associated with the viewer.

14. An apparatus for providing a consistent visual appearance of one or more pixels of a display screen with respect to a viewing position by compensating for variations between one or more perceived pixel level values associated with the one or more pixels and one or more corresponding pixel level values associated with the one or more pixels, the variations associated with one or more viewing angles between one or more locations of the one or more pixels and the viewing position, the apparatus comprising:

a display;

a memory; and a processor coupled to the memory and the display, the processor configured to:

establish the viewing position based on one or more received user inputs;

apply a respective different correction factor to each of the one or more corresponding pixel level values, the respective different correction factor being based on a respective viewing angle formed between a specific location on the display screen of the one or more pixels and the viewing position;

detect a change in a relative orientation between a display orientation and the viewing position; and apply a second respective different correction factor to each of the one or more corresponding pixel level values based on the detected chance in the relative orientation.

15. The apparatus of claim 14, wherein the step of applying the respective different correction factor further includes establishing one or more different non-linear correction curves corresponding to the one or more locations, the different non-linear correction curves relating a range of pixel level values to a corresponding range of corrected pixel level values associated with the viewing position.

16. The apparatus of claim 14, wherein the processor, in establishing the viewing position, is further configured to:

display a calibration pattern on the display screen;

receive one or more user inputs associated with the one or more locations responsive to the display of the calibration pattern; and establish the viewing position and one or more non-linear correction curves for each of the one or more locations relative to the established viewing position based on the one or more received user inputs.

17. The apparatus of claim 16, wherein the processor is further configured to:

store the received one or more user inputs with an association to a user identity; and process a user input to obtain the user identity and the one or more stored user inputs associated therewith;

wherein the processor, in establishing the viewing position is further configured to establish the viewing position and one or more non-linear correction curves for each of the one or more locations relative to the established viewing position based on the one or more user inputs.

18. The apparatus of claim 14, wherein the processor, in applying the second respective different correction factor, is further configured to establish one or more second different non-linear correction curves corresponding to one or more relative orientations between the display orientation and the viewing position, the second different non-linear correction curves relating the range of pixel level values to a second corresponding range of corrected pixel level values associated with the one or more relative orientations.

19. The apparatus of claim 14, wherein the processor, in applying the different correction factor, is further configured to:

determine if the viewing position and a location of the each corresponds to a first reference location; and interpolate using the first reference location and a second reference location to arrive at an interpolated correction factor if the determined location of the each does not correspond to the first reference location.

20. The apparatus of claim 14, wherein the processor, in applying the second different correction factor, is further configured to:

determine if the changed relative orientation corresponds to a first reference orientation; and interpolate using the first reference orientation and a second reference orientation to arrive at an interpolated correction factor if the determined changed relative orientation does not correspond to the first reference orientation.

21. The apparatus of claim 14, wherein the processor, in applying the different correction factor, is further configured to apply an analytical function to generate the different correction factor.

22. The apparatus of claim 14, wherein the processor, in applying the second different correction factor, is further configured to apply an analytical function to generate the second different correction factor.

23. The apparatus of claim 14, further comprising one or more sensors, and wherein the processor, in detecting, is further configured to read the one or more sensors indicating one or more of: display orientation and viewing position.

24. The apparatus of claim 23, wherein the one or more sensors include one or more of: a display orientation sensor, a viewing position sensor, a viewer feature tracking sensor.

25. The apparatus of claim 24, wherein the viewing position sensor further includes a sensor for sensing the position of a remote device coupled to the viewer.

26. The apparatus of claim 24, wherein the viewer feature tracking sensor further includes a camera for generating an image associated with a viewer, and wherein the processor is further configured to analyze the image to track one or more features associated with the viewer.

27. An article of manufacture for providing a consistent visual appearance of one or more pixels of a display screen with respect to a viewing position by compensating for variations between one or more perceived pixel level values associated with the one or more pixels and one or more corresponding pixel level values associated with the one or more pixels, the variations associated with one or more viewing angles between one or more locations of the one or more pixels and the viewing position, the article of manufacture comprising:

a computer readable medium; and instruction carried on the computer readable medium, the instructions readable by a processor, the instructions for causing the processor to:

establish the viewing position based on one or more received user inputs;

apply a respective different correction factor to each of the one or more corresponding pixel level values, the respective different correction factor being based on a respective viewing angle formed between a specific location on the display screen of the one or more pixels and the viewing position;

detect a change in a relative orientation between a display orientation and the viewing position; and apply a second respective different correction factor to each of the one or more corresponding pixel level values based on the detected change in the relative orientation.

28. The article of manufacture of claim 27, wherein the instructions, in causing the processor to applying the respective different correction factor, further causes the processor to establish one or more different non-linear correction curves corresponding to the one or more locations, the different non-linear correction curves relating a range of pixel level values to a corresponding range of corrected pixel level values associated with the viewing position.

29. The article of manufacture of claim 27, wherein the instructions, in causing the processor to establish the viewing position, further cause the processor to:

display a calibration pattern on the display screen;

receive one or more user inputs associated with the one or more locations responsive to the display of the calibration pattern; and establish the viewing position and one or more non-linear correction curves for each of the one or more locations relative to the established viewing position based on the one or more received user inputs.

30. The article of manufacture of claim 29, wherein the instructions further cause the processor to:

store the received one or more user inputs with an association to a user identity; and process a user input to obtain the user identity and the one or more stored user inputs associated therewith;

wherein the instructions, in causing the processor to establish the viewing position, further cause the processor to establish the viewing position and one or more non-linear correction curves for each of the one or more locations relative to the established viewing position based on the one or more user inputs.

31. The article of manufacture of claim 27, wherein the instructions, in causing the processor to apply the second respective different correction factor, further cause the processor to establish one or more second different non-linear correction curves corresponding to one or more relative orientations between the display orientation and the viewing position, the second different non-linear correction curves relating the range of pixel level values to a second corresponding range of corrected pixel level values associated with the one or more relative orientations.

32. The article of manufacture of claim 27, wherein the instructions, in causing the processor to apply the different correction factor, further cause the processor to:

determine if the viewing position and a location of the each corresponds to a first reference location; and interpolate using the first reference location and a second reference location to arrive at an interpolated correction factor if the determined location of the each does not correspond to the first reference location.

33. The article of manufacture of claim 27, wherein the instructions, in causing the processor to apply the second different correction factor further cause the processor to:

determine if the changed relative orientation corresponds to a first reference orientation; and interpolate using the first reference orientation and a second reference orientation to arrive at an interpolated correction factor if the determined changed relative orientation does not correspond to the first reference orientation.

34. The article of manufacture of claim 27, wherein the instructions, in causing the processor to apply the different correction factor, further cause the processor to apply an analytical function to generate the different correction factor.

35. The article of manufacture of claim 27, wherein the instructions, in causing the processor to apply the second different correction factor, further cause the processor to apply an analytical function to generate the second different correction factor.

36. The article of manufacture of claim 27, wherein the instructions, in causing the processor to detect, further cause the processor to read one or more sensors indicating one or more of: display orientation and viewing position.

37. A computer system for providing a consistent visual appearance of one or more pixels of a display screen with respect to a viewing position by compensating for variations between one or more perceived pixel level values associated with the one or more pixels and one or more corresponding pixel level values associated with the one or more pixels, the variations associated with one or more viewing angles between one or more locations of the one or more pixels and the viewing position, the method comprising the steps of:

means for establishing the viewing position based on one or more received user inputs;

means for applying a respective different correction factor to each of the one or more corresponding pixel level values, the respective different correction factor being based on a respective viewing angle formed between the specific location on the display screen of the one or more pixels and a viewing position; and means for detecting a change in a relative orientation between a display orientation and the viewing position; and means for applying a second respective different correction factor to each of the one or more corresponding pixel level values based on the detected change in the relative orientation.

38. The computer system of claim 37, wherein the means for applying the respective different correction factor further includes means for establishing one or more different non-linear correction curves corresponding to the one or more locations, the different non-linear correction curves relating a range of pixel level values to a corresponding range of corrected pixel level values associated with the viewing position.

39. The computer system of claim 37, wherein the means for establishing the viewing position further includes:

means for displaying a calibration pattern on the display screen;

means for receiving one or more user inputs associated with the one or more locations responsive to the display of the calibration pattern; and means for establishing the viewing position and one or more non-linear correction curves for each of the one or more locations relative to the established viewing position based on the one or more received user inputs.

40. The computer system of claim 39, further including:

means for storing the received one or more user inputs with an association to a user identity; and means for processing a user input to obtain the user identity and the one or more stored user inputs associated therewith;

wherein the means for establishing the viewing position further includes means for establishing the viewing position and one or more non-linear correction curves for each of the one or more locations relative to the established viewing position based on the one or more user inputs.

41. The computer system of claim 37, wherein the means for applying the second respective different correction factor further includes means for establishing one or more second different non-linear correction curves corresponding to one or more relative orientations between the display orientation and the viewing position, the second different non-linear correction curves relating the range of pixel level values to a second corresponding range of corrected pixel level values associated with the one or more relative orientations.

42. The computer system of claim 37, wherein the means for applying the different correction factor further includes:

means for determining if the viewing position and a location of the each corresponds to a first reference location; and means for interpolating using the first reference location and a second reference location to arrive at an interpolated correction factor if the determined location of the each does not correspond to the first reference location.

43. The computer system of claim 37, wherein the means for applying the second different correction factor further includes:

means for determining if the changed relative orientation corresponds to a first reference orientation; and means for interpolating using the first reference orientation and a second reference orientation to arrive at an interpolated correction factor if the determined changed relative orientation does not correspond to the first reference orientation.

44. The computer system of claim 37, wherein the means for applying the different correction factor further includes the means for applying an analytical function to generate the different correction factor.

45. The computer system of claim 37, wherein the means for applying the second different correction factor further includes means for applying an analytical function to generate the second different correction factor.

46. The computer system of claim 37, wherein the means for detecting further includes means for reading one or more sensors indicating one or more of: display orientation and viewing position.

47. The computer system of claim 46, wherein the one or more sensors include one or more of: a display orientation sensor, a viewing position sensor, a viewer feature tracking sensor.

48. The computer system of claim 47, wherein the viewing position sensor further includes a sensor for sensing the position of a remote device coupled to the viewer.

49. The computer system of claim 47, wherein the viewer feature tracking sensor further includes a camera for generating an image associated with a viewer, and a means for analyzing the image to track one or more features associated with the viewer.

* * * * *